US007322107B2

(12) United States Patent
Lam

(10) Patent No.: US 7,322,107 B2
(45) Date of Patent: Jan. 29, 2008

(54) MANICURING APPLIANCE

(75) Inventor: Phillip L Lam, Monterey Park, CA (US)

(73) Assignee: Perfect Nail Products, Inc., Rancho Santa Fe, CA (US)

( * ) Notice: Subject to any disclaimer, the term of this patent is extended or adjusted under 35 U.S.C. 154(b) by 164 days.

(21) Appl. No.: 10/753,019

(22) Filed: Jan. 6, 2004

(65) Prior Publication Data

US 2005/0055831 A1 Mar. 17, 2005

Related U.S. Application Data

(60) Provisional application No. 60/504,593, filed on Sep. 16, 2003.

(51) Int. Cl.
*A45D 29/18* (2006.01)
*A45D 29/00* (2006.01)

(52) U.S. Cl. ..... 30/26; 132/75.4; 132/75.3

(58) Field of Classification Search ..... 30/26; 132/73, 75.3, 75.4
See application file for complete search history.

(56) References Cited

U.S. PATENT DOCUMENTS

| | | | | | |
|---|---|---|---|---|---|
| 1,855,063 | A * | 4/1932 | Lovette | 30/26 |
| 1,888,218 | A * | 11/1932 | Bynum | 132/76.5 |
| 2,229,614 | A * | 1/1941 | Tellier et al. | 30/26 |
| 2,534,666 | A * | 12/1950 | Grisso | 30/26 |
| 2,918,924 | A * | 12/1959 | Pesko | 132/75.4 |
| 5,755,239 | A * | 5/1998 | Baltierra | 132/73 |
| 6,155,270 | A * | 12/2000 | Samiean | 132/73 |
| 6,944,959 | B2 * | 9/2005 | Bigden et al. | 30/392 |
| 2005/0092337 | A1 * | 5/2005 | Cyrus | 132/73 |

* cited by examiner

*Primary Examiner*—Kenneth E. Peterson
*Assistant Examiner*—Sean Michalski
(74) *Attorney, Agent, or Firm*—Leonard Tachner

(57) ABSTRACT

A manicuring appliance comprising a hand held center section with proximal and distal end sections each of which may be detachable from the center section. Each end section may have a lip shaped to bear against the base of the cuticle. The distal end section comprises a pusher for shaping the cuticle and prepare it for cutting by the proximal end section. The proximal end section includes a cutting blade positioned to properly cut or trim the cuticle along an arc which follows the arc of the cuticle base as the user moves the appliance along the cuticle. Various alternative embodiments of the proximal cutting section are disclosed.

7 Claims, 13 Drawing Sheets

MANICURING APPLIANCE

CROSS-REFERENCE TO RELATED APPLICATIONS

The present invention takes priority from provisional application Ser. No. 60/504,593 filed on Sep. 16, 2003.

BACKGROUND OF THE INVENTION

1. Field of the Invention

This invention relates to manicuring appliances and more particularly to a cuticle cutter and shaper convenient to use with either hand.

2. Background Art

Cuticle clippers presently are in use primarily in beauty salons. They have the familiar form of a small pinching type device with short curved spring loaded blades which permits movement along the curvatures of a cuticle. Such clippers are hard to self administer and are used primarily by a beauty salon operator. They are prone to cut the cuticle too deeply and cause injury and bleeding.

SUMMARY OF THE INVENTION

The invention is based on the realization that cuticles can be shaped and cut in a simple manner by an appliance which moves one or more cutting blades along the path of the cuticle rather than using the pinching action presently practiced. Accordingly, a manicuring appliance, in accordance with the principles of this invention, comprises an elongated, hand held, member with a proximal end adapted to engage a cuticle and to position a cutting blade along the cuticle. The blade edge may be, at least in part, perpendicular to both the length and width of the appliance.

The proximal end may include a lip which seats against the base of the cuticle as the guiding surface for the path of the blade.

In a preferred embodiment, the hand held member is fabricated in at least two detachable pieces with the (proximal) end containing the cutting blade being disposable. In another embodiment, the proximal end is adapted to accept a cap which stores a blade where the cap is disposable.

Also in the preferred embodiment, the distal end of the elongated member also is detachable. The distal end, detachable or not, is shaped as a pusher and includes a metal pushing surface. The pusher end is of a shape to allow controlled shaping of the cuticle as will be explained more fully hereinafter.

In still other embodiments, the proximal and distal ends are provided with release mechanisms to facilitate quick and convenient connection and release relative to the elongated hand-held member or handle. One or both of the end sections may be made of a transparent plastic and one or two directional illuminating devices may be provided in the handle to provide added light for aiding observation of the manicuring operation. Finally, unique one-piece dual cutting blades are disclosed for cutting in either of two directions.

BRIEF DESCRIPTION OF THE DRAWINGS

The aforementioned objects and advantages of the present invention, as well as additional objects and advantages thereof, will be more fully understood hereinafter as a result of a detailed description of a preferred embodiment when taken in conjunction with the following drawings in which.

DETAILED DESCRIPTION OF ILLUSTRATIVE EMBODIMENTS OF THE INVENTION

Figure 1:
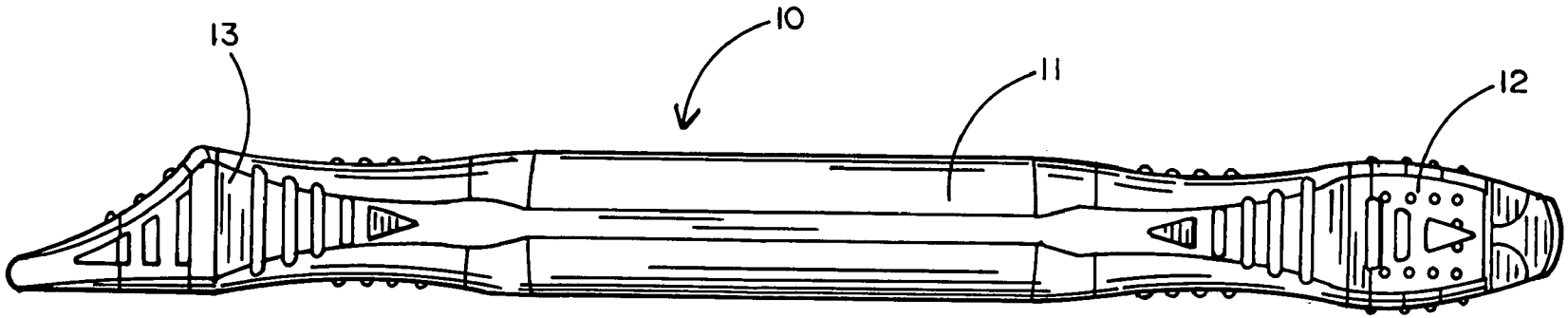
FIGS. 1 and 2 are top and side views, respectively, of a manicuring appliance in accordance with a preferred embodiment of the invention.
Figure 2:
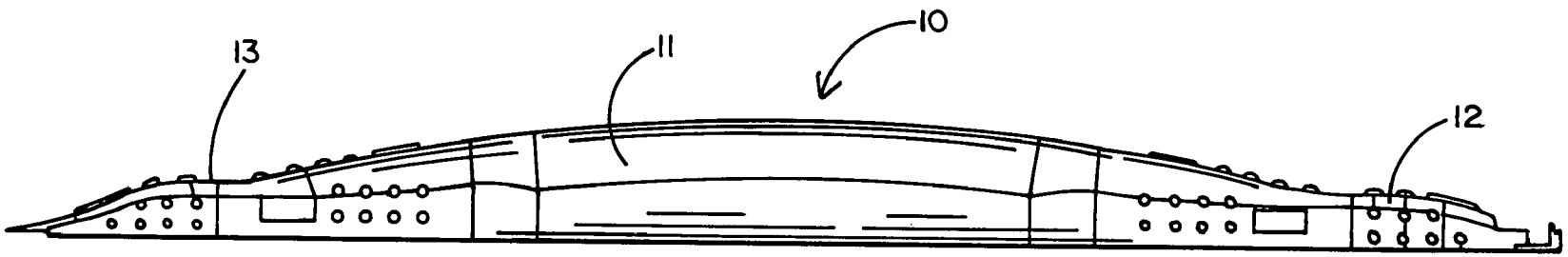
Figure 3:
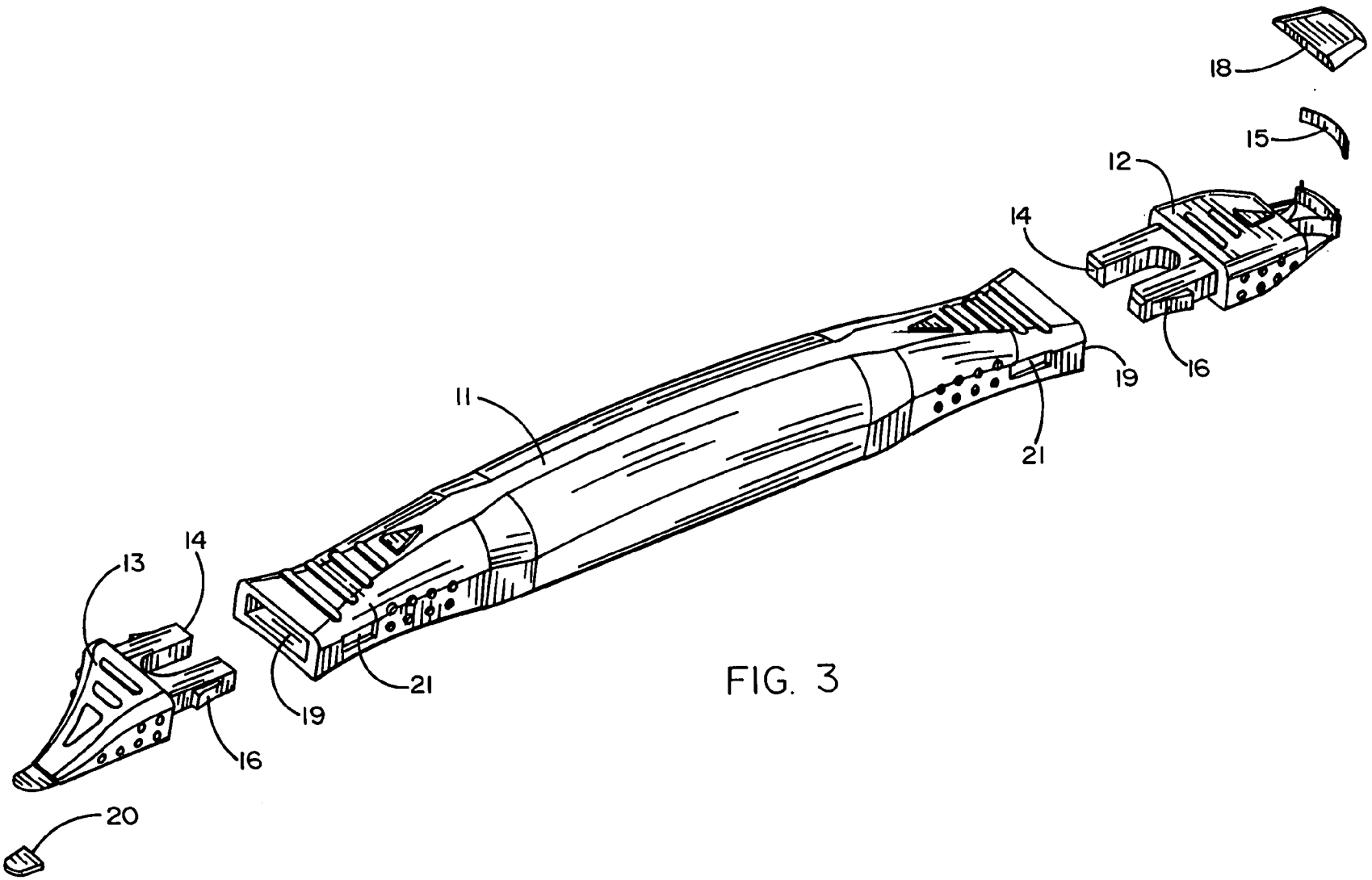
FIG. 3 is an exploded three-dimensional view of the appliance of FIGS. 1 and 2 showing a "hand held" central member with attachable proximal and distal sections.
Figure 4:
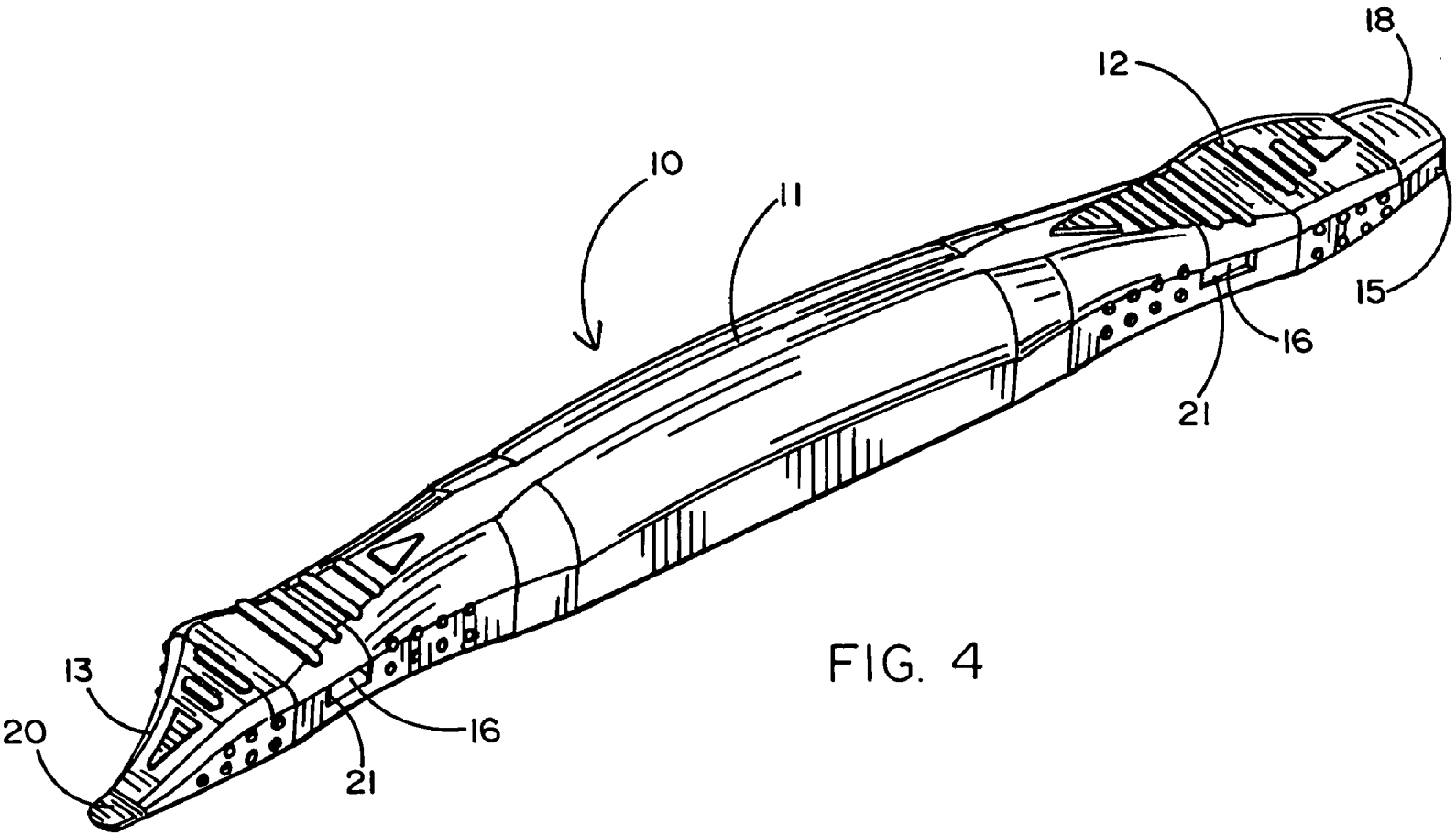
FIG. 4 is an assembled three-dimensional view of the embodiment of FIG. 3.

FIGS. 1 and 2 show top and side views, respectively, of an appliance 10 in accordance with the principles of this invention. The appliance may be fabricated in a single integrated unit or in separate sections as shown in FIGS. 1 and 2. In either case, the appliance includes a center member or section 11 and proximal and distal sections 12 and 13 respectively. The appliance is preferably about eight inches long by about one-half inch wide by about one quarter inch thick. As shown in FIGS. 3 and 4, the proximal section 12 comprises a pair of probes 14 each having a securing tab 16 for engaging apertures 21 inside a hollow end 19 of the center member or handle section 11. Proximal section 12 receives a blade 15 and a retention cap 18. Distal section 13 also has probes 14 with securing tabs 16 for engaging apertures 21 in the other hollow end 19 of handle 11. Distal section 13 preferably receives a metal tip 20 to provide a hard pushing surface.

Figure 5:
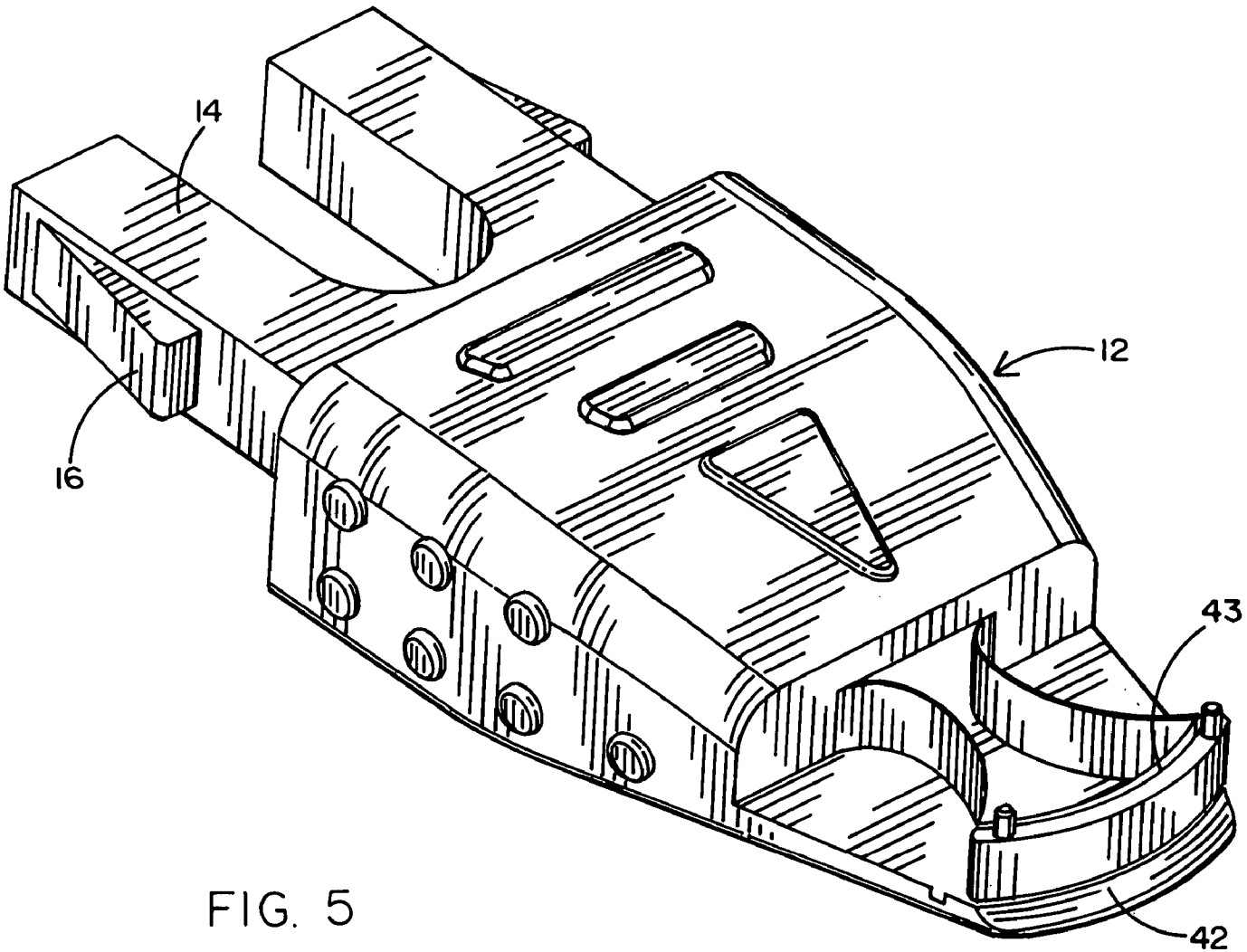
FIG. 5 is an enlarged representation of the proximal section of the appliance of FIG. 4 showing structure for retaining the cutting blade in place.
Figure 7:
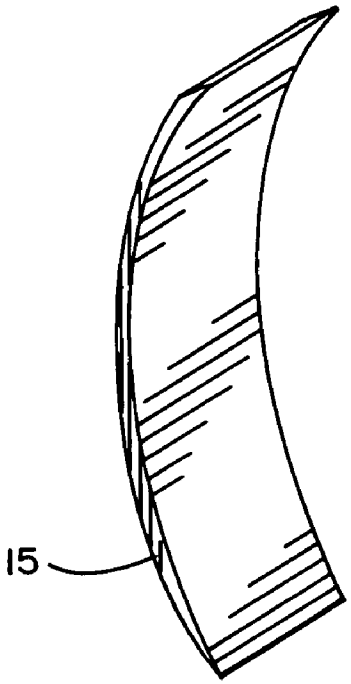
FIG. 7 is a three-dimensional view of a cutting blade used in the proximal section of FIG. 5.
Figure 6:
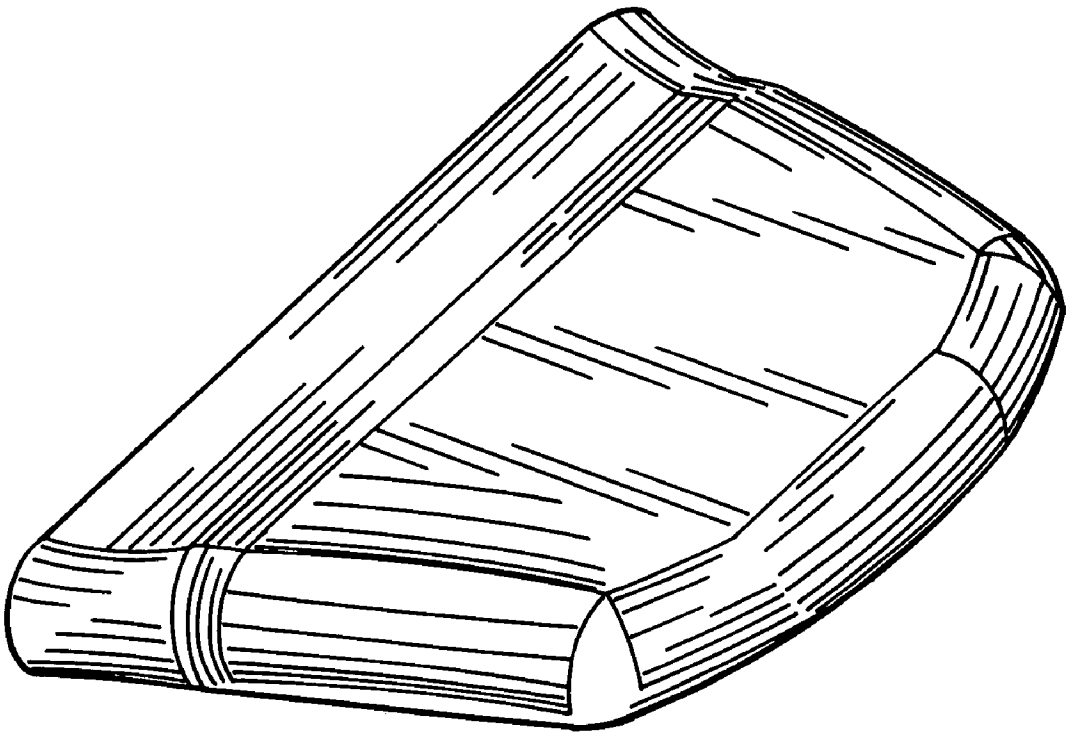
FIG. 6 is a three-dimensional view of a blade retention cap used in the proximal section of FIG. 5.

FIG. 5 shows enlarged a proximal section 12 of the appliance of FIG. 3. Section 12 includes a lip 42 which is placed by a user beneath a cuticle so that it rests against the base of the cuticle. The proximal section contains an upstanding wall 43 which supports a cutting blade 15. The cutting blade shown in FIG. 7, extends beyond the left end of wall 43, as viewed and may also extend beyond the right end of wall 43. The extension of the blade beyond the wall positions the blade edges to cut the cuticle along an arc which follows the shape of the cuticle base against which lip 42 bears as the appliance 10 is moved by a user. FIG. 6 illustrates the cap 18 and FIG. 7 shows the blade 15.

Figure 8:
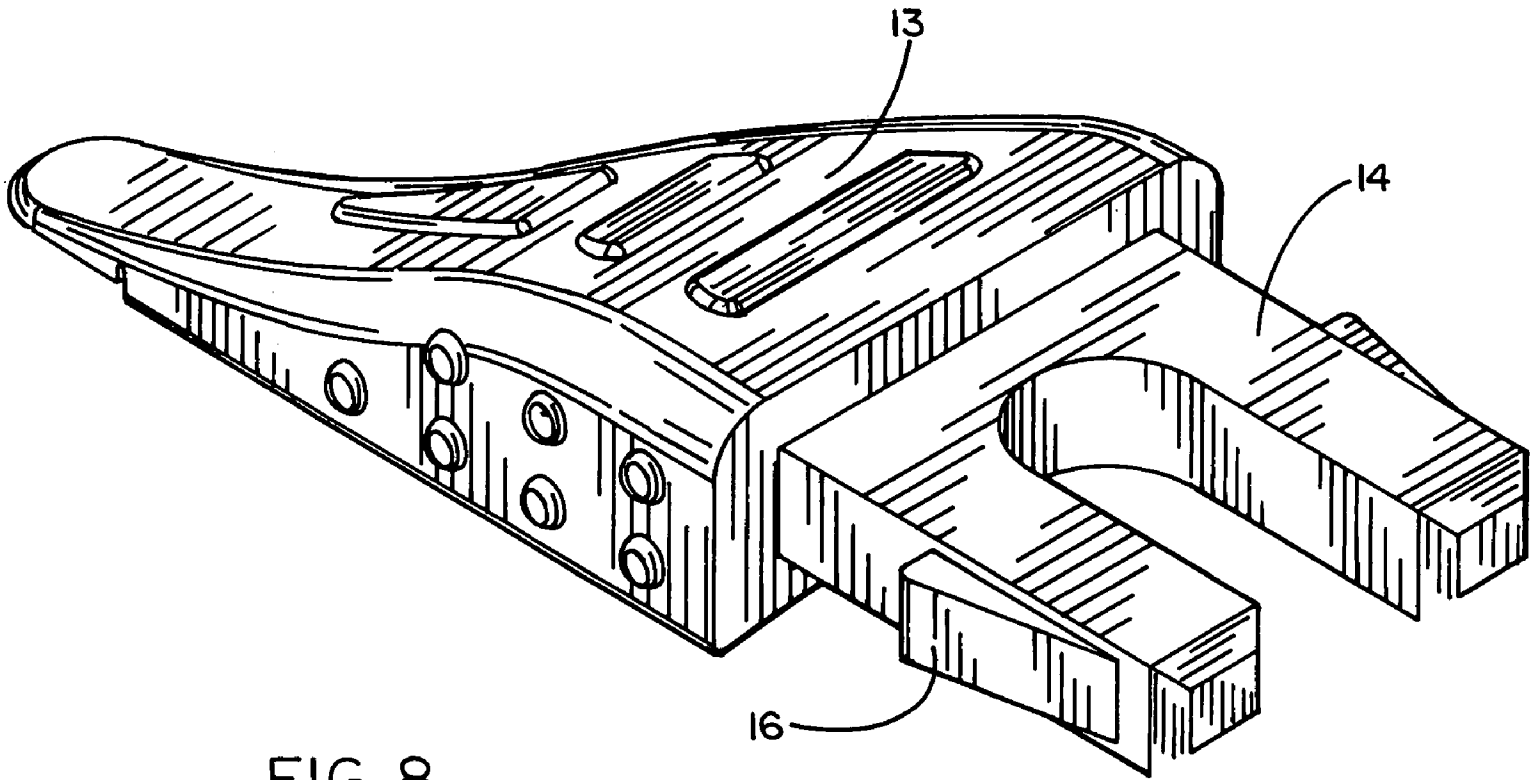
FIG. 8 is a three-dimensional view of a pusher distal section of the preferred embodiment.

FIG. 8 is an enlarged view of the distal end section 13.

Figure 10:
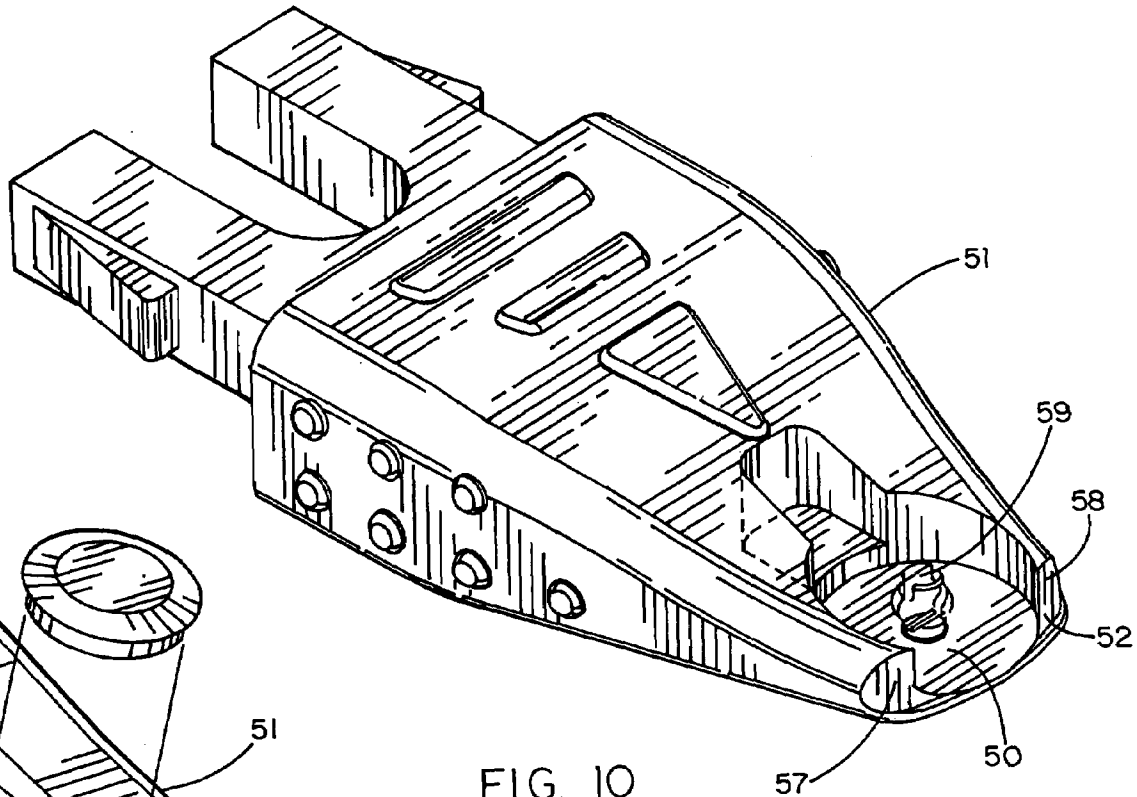
FIG. 10 is a three-dimensional view of the proximal section of FIG. 9.
Figure 9:
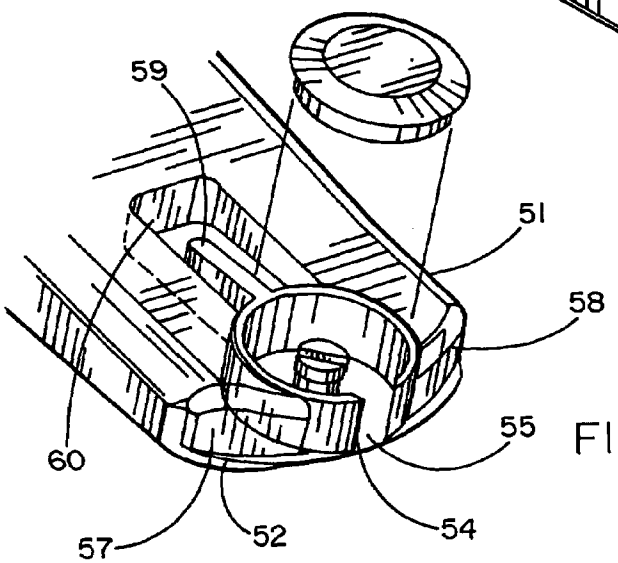
FIG. 9 is an enlarged three-dimensional view of an alternative proximal section blade configuration.

FIGS. 9 and 10 show an alternative proximal section 51 of the appliance of FIGS. 1 to 3. In this embodiment also, the section includes a lip 52 dimensioned to seat against the base of the cuticle in order to control the path of the cutting blade 54 as a user moves the appliance.

Note that in the embodiment of FIGS. 9 and 10, the cutting blade is in the shape of a circular band with an opening at 55. The opening is formed so that the cutting edges, formed to either side of the opening, project beyond supporting walls 57 and 58. Also to be noted is that the circular band has an extension 59 which sits in a recess 60 in which it is free to move in a horizontal plane. The freedom of movement is to allow the blade to adjust itself or to be adjusted for proper cutting when the appliance is moved in either direction along the cuticle.

Figure 11:
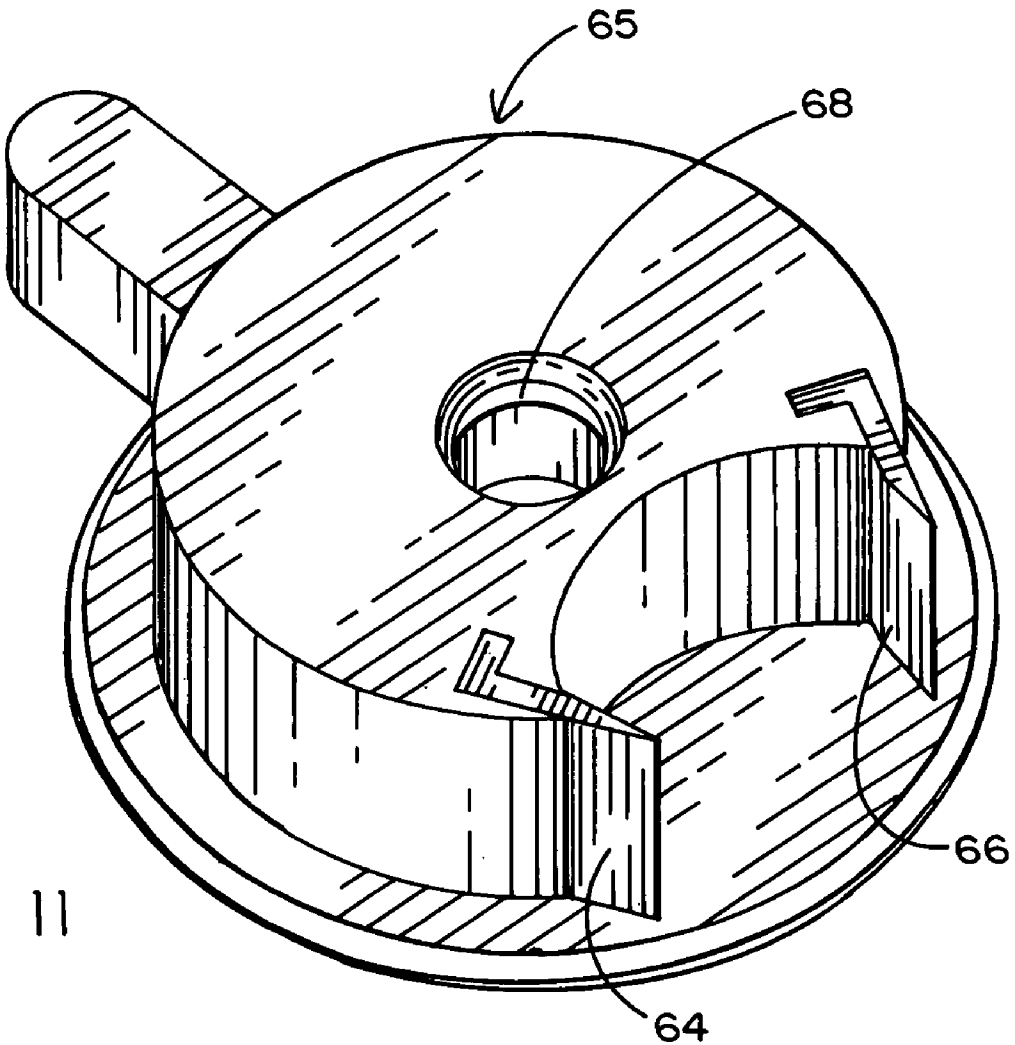
FIG. 11 is an inverted three-dimensional view of a disposable bladed cap used in yet another embodiment of the invention.
Figure 12:
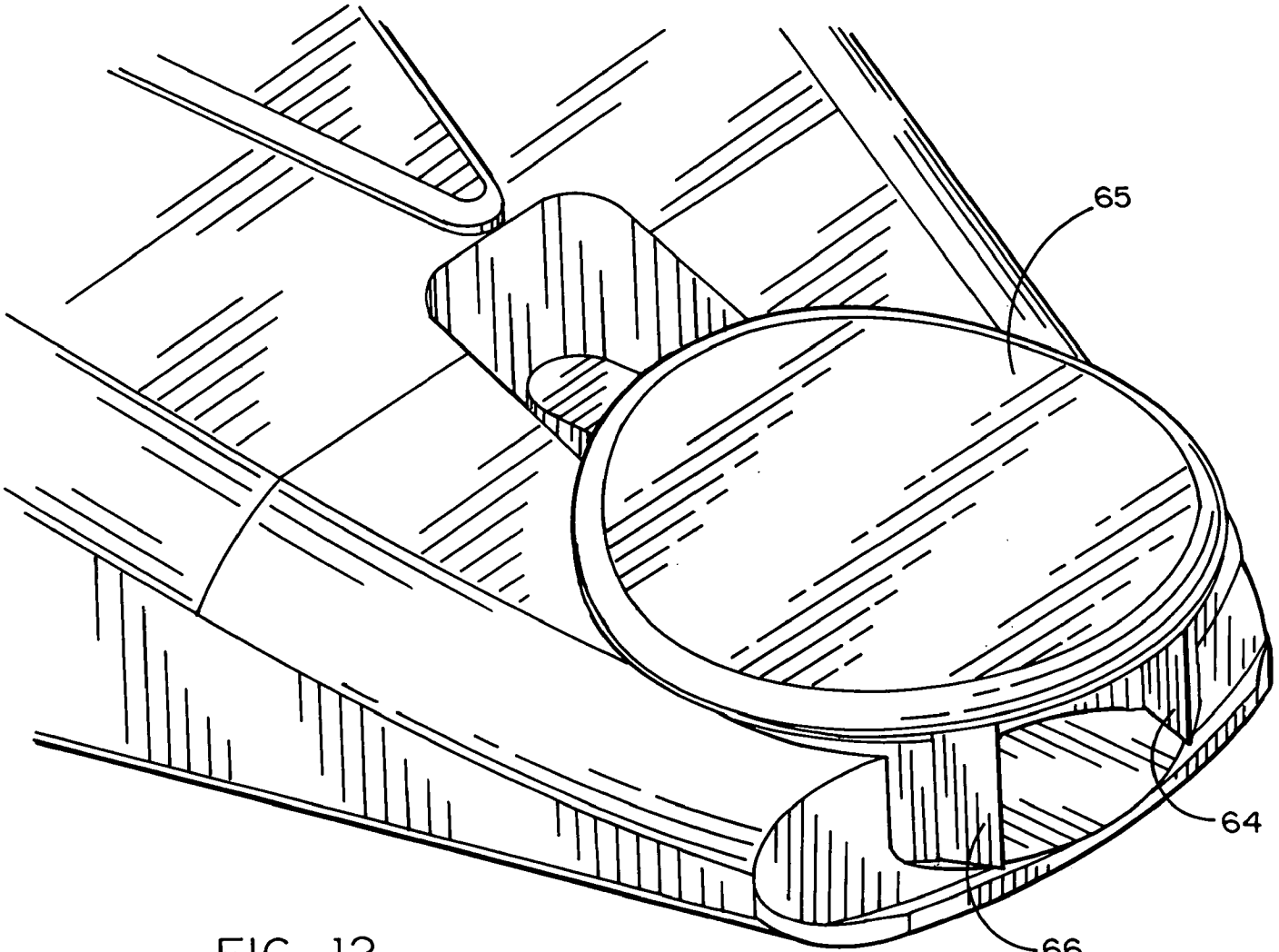
FIG. 12 is an enlarged three-dimensional view of an illustrative detachable proximal section using the disposable bladed cap of FIG. 11.

FIGS. 11 and 12 are schematic illustrations of another embodiment of the proximal cutting section showing a cap 65 for retaining two cutting blades 64 and 66 in place. In this embodiment of the invention, blades 64 and 66 reside in cap 65. In the embodiments of FIGS. 11 and 12, the cap is disposable. Cap 65 is configured to be located into recess 50 of proximal section 51 as shown in FIG. 12 with a center recess 68 being positioned on a vertical post 59. (See FIG. 10).

Figure 13:
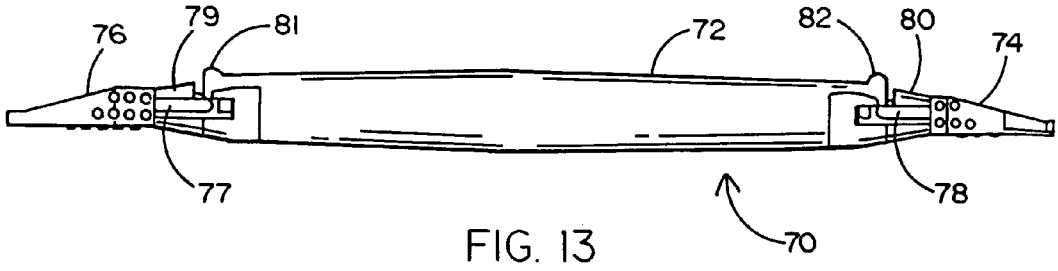
FIG. 13 is a side cross-sectional view showing an embodiment having a quick-release mechanism.
Figure 14:
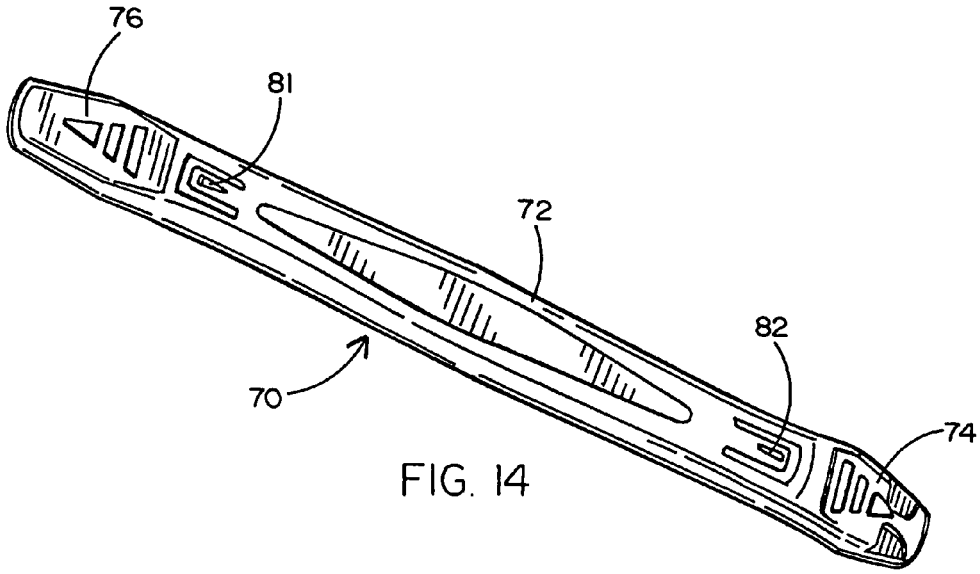
FIG. 14 is a three-dimensional view of the embodiment of FIG. 13.

Another embodiment of the present invention is shown in FIGS. 13 and 14. This alternative embodiment 70 utilizes a quick-release configuration which permits more convenient removal and replacement of the ends from the handle. Embodiment 70 comprises a handle 72 and detachable ends 74 and 76. Each end is connected to the handle by an insert 77, 78 which engages a handle retaining bracket 79, 80. A lever configured release mechanism 81, 82 depresses a respective insert to disengage it from its corresponding retaining bracket. An end 74 or 76 is therefore simply released from handle 72 by depressing along the upper surface of the handle as seen best in FIG. 14.

Figure 15:
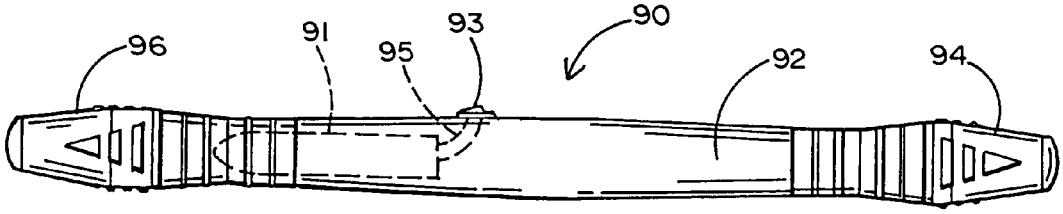
FIG. 15 is a top view of an embodiment having a transparent end member and an illuminating device in the handle for aiding in seeing a manicuring operation.
Figure 18:
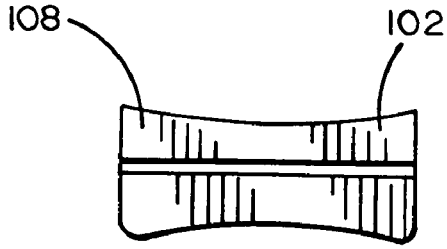
FIGS. 16 to 19 provide various views of an embodiment of a cutting blade having two cutting edges.
Figure 16:
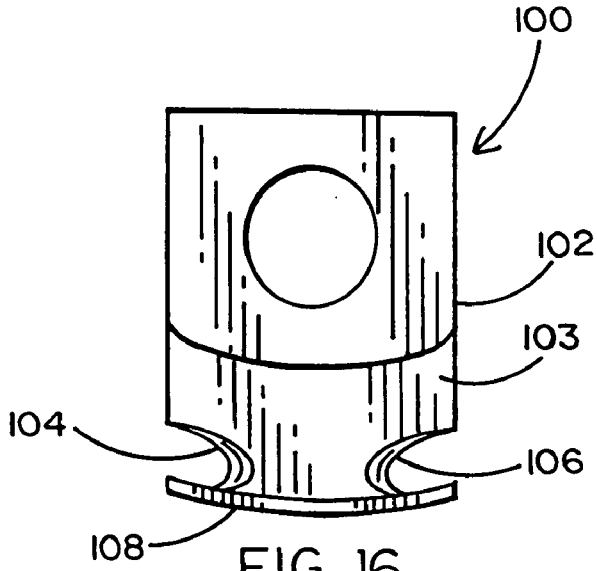
Figure 17:
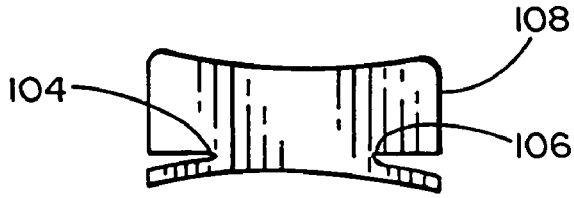
Figure 19:
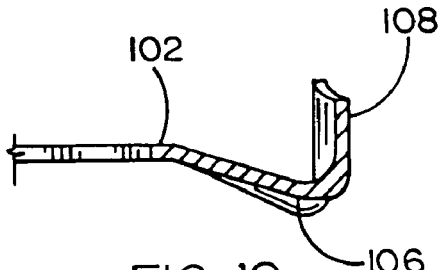
Figure 22:
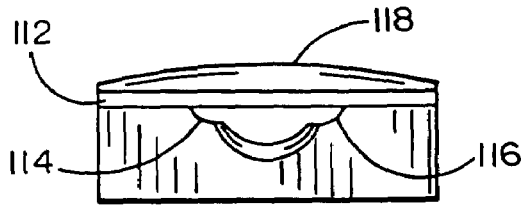
FIGS. 20 to 23 provide various views of another dual cutting edge blade embodiment.
Figure 20:
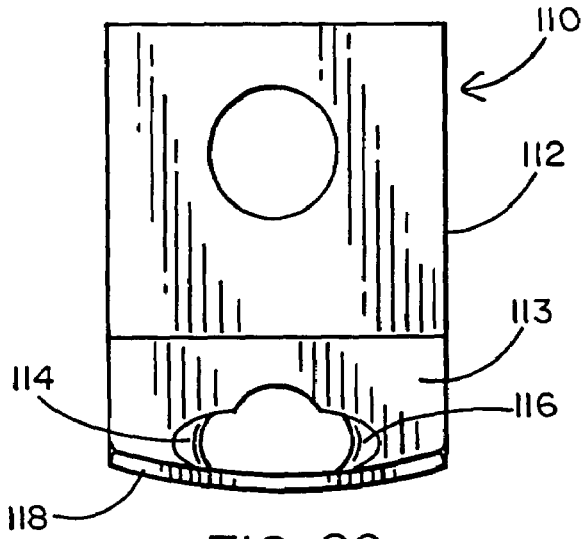
Figure 21:
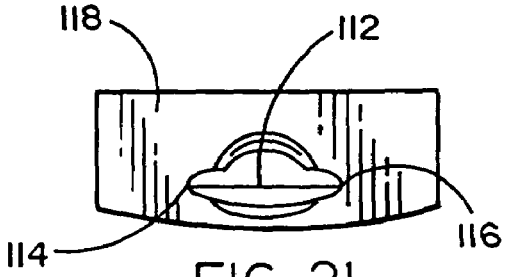

Still another alternative embodiment is shown in FIG. 15. In embodiment 90, an illuminating device 91 (LED, incandescent light, etc.) including an internal battery is positioned in handle 92 pointing toward a transparent plastic end 96 to provide concentrated light for facilitating manicuring operations. The illuminating device 91 is connected by internal wires 95 to an external switch 93 along the side of handle 92. A similar illuminating device may optionally be provided for end 94.

Two alternative dual cutting edge blade embodiments are shown in FIGS. 16-23. Blade embodiment 100 comprises a flat metal sheet 102 having a folded region 103 which forms an L-shaped cross-section as seen best in FIG. 19. Two opposed scoops or cutting edges 104 and 106 are formed at the fold and a curved foreshortened front end 108 is provided and acts as a cuticle guard for the blade 100.

Figure 23:
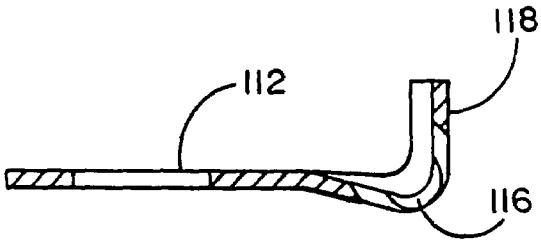

Blade embodiment 110 comprises a flat metal sheet 112 having a folded region 113 which forms an L-shaped cross-section as seen best in FIG. 23. An oval notch 115 is provided at the fold and two opposed scoops or cutting edges 114 and 116 are formed at opposed sides of the notch. A curved foreshortened front end 118 is provided and acts as a cuticle guard for the blade 110.

Figure 24:
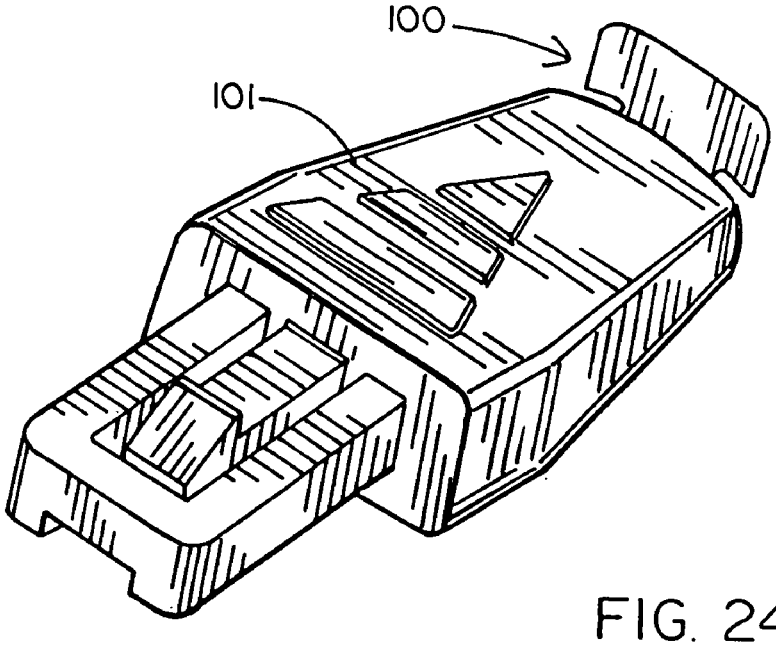
FIG. 24 is a three-dimensional view of the blade of FIGS. 16-19 shown mounted in an end portion of a manicuring appliance.
Figure 25:
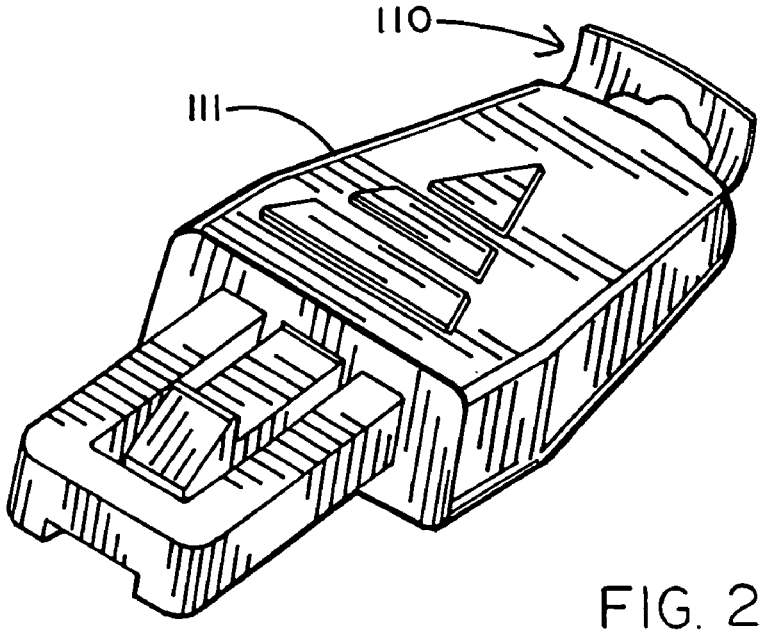
FIG. 25 is a three-dimensional view of the blade of FIGS. 20-33 shown mounted in an end portion of a manicuring appliance.

Both blade embodiments 100 and 110 permit safe cutting of excess cuticle tissue along the nail surface in either direction while protecting the area beyond the cuticle from inadvertent cutting. FIG. 24 illustrates blade embodiment 100 shown installed in an end portion 101 and FIG. 25 illustrates blade embodiment 110 shown installed in an end portion 111.

Each of the various embodiments herein functions to place at least one cutting blade in a position to trim a cuticle by moving the blade along an arc which follows the arc of the cuticle base. The appliance may be moved in either direction along the cuticle which permits easy control by a left-handed or right-handed user.

The invention provides a convenient means for removing outer layers of dead cuticle skin without the risk of injury to the cuticle associated with conventional cuticle cutters or trimmers.

Having thus disclosed various illustrative embodiments of my invention, it will be understood that the scope hereof is to be limited only by the appended claims and their equivalents.

I claim:

1. A manicuring appliance comprising:

an elongated member having first and second ends; and a proximal member coupled to said first end of said elongated member, said proximal member having a first end including a first circular recess and a circular band cutting blade positioned for rotation in said first recess, said circular band cutting blade having an opening at a first circumferential end in peripheral surface defining opposed cutting edges and an extension member on an opposed second circumferential end thereof, said extension member being received in a second recess formed in said proximal member and displaceable therein, said circular band cutting blade being displaceable responsive to displacement of said extension member.

2. The manicuring appliance as recited in claim 1 further comprising a distal member coupled to said second end of said elongated member, said distal member having a pusher at a first end for shaping a cuticle and preparing it for cutting.

3. The manicuring appliance as recited in claim 2, wherein said proximal member is releasably coupled to said first end of said elongated member and said distal member is releasably coupled to said second end of said elongated member.

4. The manicuring appliance as recited in claim 3, wherein said elongated member includes a hollow cavity at said first and second ends thereof.

5. The manicuring appliance as recited in claim 4 wherein said elongated member further includes a pair of apertures on each of said first and second ends thereof.

6. The manicuring appliance as recited in claim 5, where said proximal member includes a pair of probes protruding from a second end thereof, each said probe respectively having a securing tab projecting therefrom, wherein, said pair of probes being received in said hollow cavity of said first end of said elongated member and each said securing tab being received in each respective one of said apertures of said first end of said elongated member when said proximal member is coupled to said elongated member.

7. The manicuring appliance as recited in claim 5, where said distal member includes a pair of probes protruding from a second end thereof, each said probe respectively having a securing tab projecting therefrom, wherein, said pair of probes are received in said hollow cavity of said second end of said elongated member and each said securing tab being received in each respective one of said apertures of said second end of said elongated member when said distal member is coupled to said elongated member.

* * * * *